United States Patent [19]

Brickhouse

[11] 4,406,315

[45] Sep. 27, 1983

[54] PENCIL SHARPENER

[75] Inventor: Todd Brickhouse, Copiague, N.Y.

[73] Assignee: Collier Bros., Copiague, N.Y.

[21] Appl. No.: 237,091

[22] Filed: Feb. 20, 1981

[51] Int. Cl.[3] ..... B43L 23/08

[52] U.S. Cl. ..... 145/3.31; 145/3.61

[58] Field of Search ..... 145/3.1, 3.3, 3.31, 145/3.5, 3.6, 3.61; 144/28.1, 28.11, 28.2, 28.3

[56] References Cited

U.S. PATENT DOCUMENTS 653,720 7/1900 Weitzel ..... 145/3.31

703,967 7/1902 O'Byrne ..... 145/3.6

942,107 12/1909 Rydquist ..... 145/3.6

1,266,806 5/1918 Hoeller ..... 145/3.61

*Primary Examiner*—Donald R. Schran

*Attorney, Agent, or Firm*—Brumbaugh, Graves, Donohue & Raymond

[57] ABSTRACT

A pencil sharpener is constructed in the overall configuration of a pen, and arranged to fit within a person's breast pocket. The pencil sharpener includes a tubular receptacle having one closed end and a sharpening tool at its other, opened end. A cap is arranged to fit over the tubular receptacle to close the open end and cover the sharpening tool. Alternate tools for crayons and drawing pencils are described.

17 Claims, 15 Drawing Figures

PENCIL SHARPENER

BACKGROUND OF THE INVENTION

This invention relates to pencil sharpeners, particularly to manually operated pencil sharpeners.

In the prior art there have been known manually operated pencil sharpeners which are provided with a receptacle for receiving shaving scraps which result from the use of the sharpener. One such prior art pencil sharpener with a receptacle and dust-proof cover is described in U.S. Pat. No. 2,525,854 to Becker. The Becker pencil sharpener has a relatively short, large diameter cylindrical configuration, and it does not lend itself easily to placement within a shirt or jacket pocket in conjunction with pencils and pens.

It is an object of the present invention to provide a manually operated pencil sharpener which can be conveniently carried around in a breast pocket along with pens, pencils and other similarly shaped writing implements.

It is a further object of the inventon to provide such a pencil sharpener having interchangeable tools for sharpening different writing implements.

SUMMARY OF THE INVENTION

In accordance with the present invention, there is provided a pencil sharpener comprising an elongated substantially cylindrical tube having an open end and a closed end. The tube preferably has a diameter of less than 16 mm and forms a receptacle for shavings. A pencil sharpening tool is arranged to be connected to the open end of the tube. The tool has a generally cylindrical configuration having a first outer end and a second inner end for being received in the tube. The outer end has a conical recess formed therein for receiving a pencil end. The tool includes a first cylindrical end portion adjacent the outer end and having a diameter greater than the inside diameter of the open end. The tool also has a second, intermediate cylindrical portion having a smaller diameter and arranged to be received in and engaged by the open end. The tool has a third portion adjacent the second inner end in the form of a partial cylinder having a smaller diameter than the inside diameter of the open end. The third portion is received into the tube and has an end recess intersecting the end portion of the conical recess. The partial cylinder has a planar surface parallel to the wall of the conical recess, intersecting the recess and forming a longitudinal slot therein. The tool has a blade mounted on the planar surface and having a cutting edge extending into the conical recess through the slot. There is also provided a cap fitting over the tube and the tool to close the conical recess therein.

In a preferred embodiment, the intermediate cylindrical portion of the tool is threaded and the open end of the tube is tapped so that the tool can be screwed into the open end. The tube preferably has a length of at least 100 mm so that the pencil sharpener has the general shape of a writing implement. For convenience in carrying, the pencil sharpener cap can be provided with a pocket clip.

In one embodiment the planar surface of the third portion extends into the intermediate portion forming a partial cylindrical recess therein. In this embodiment, the blade may be tapered in width to fit within the partial cylindrical recess.

For a better understanding of the present invention, together with other and further objects, reference is made to the following description, taken in conjunction with the accompanying drawings and its scope will be pointed out in the appended claims.

DESCRIPTION OF THE INVENTION

Figure 1:
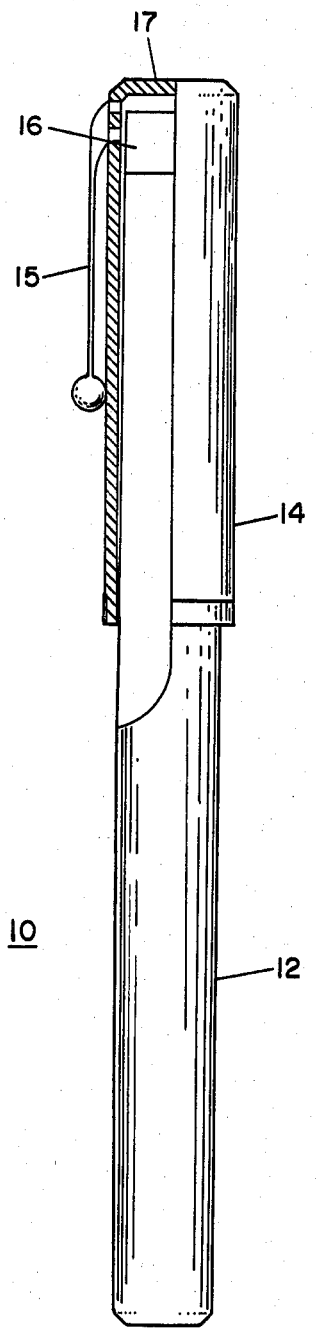
FIG. 1 is a partially cut-away plan view of a pencil sharpener in accordance with the present invention.

FIG. 1 is a side view of a pencil sharpener 10 in accordance with the present invention. As is seen from the illustration, the pencil sharpener has the general configuration of a pen or other writing instrument and is provided with a tubular receptacle 12 and a closing cap 14 so that it can be completely closed to be dust-free for carrying around in a person's jacket or shirt pocket along with other writing implements, such as pencils, pens, and markers. For convenience in carrying in the pocket the cap is provided with a clip 15.

The pencil sharpener 10 of the present invention is formed of three parts, including a tubular portion 12, which has a closed end 11 and forms a receptacle for shavings which results from sharpening a pencil. A cap 14 is provided over the tube 12 in order to close the open end of the tube having the actual pencil sharpening tool 16. Cap 14 has a closed end 17 and fits over tube 12 either by a pressure fit as a result of a minor tapering of the tube 12 toward the tool 16, or by reason of the provision of a ridge on the tube to engage a corresponding ridge receiving portion on the cap 14, all as known in the art of pens.

Figure 2:
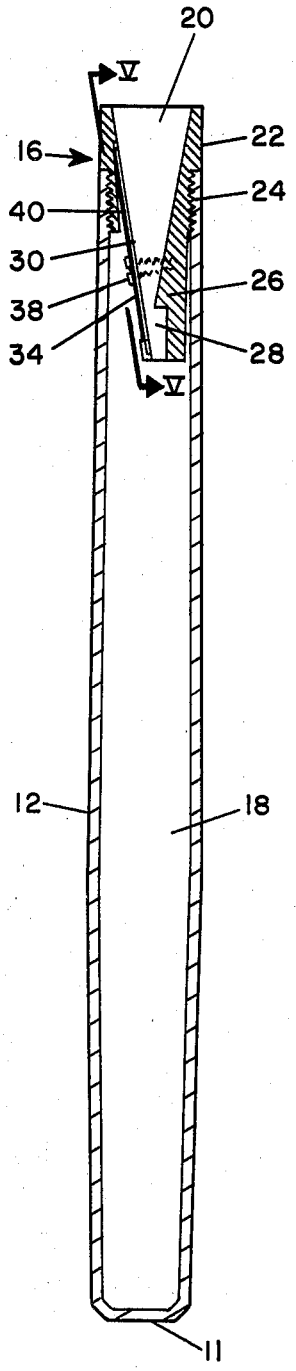
FIG. 2 is a cross-sectional view of the cylindrical tube portion and tool portion of the FIG. 1 pencil sharpener.
Figure 3:
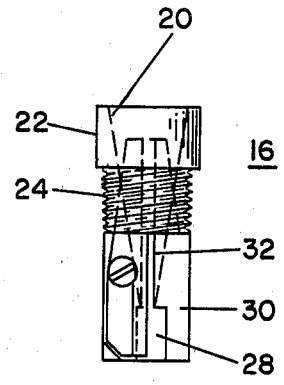
FIG. 3 is a plan view of the tool used in the FIG. 1 pencil sharpener.
Figure 4:
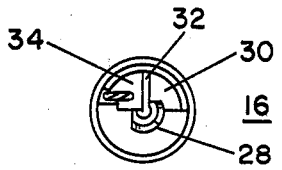
FIG. 4 is an end view thereof.
Figure 6:
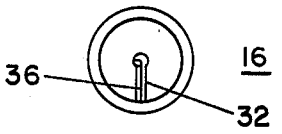
FIG. 6 is another end view thereof.
Figure 5:
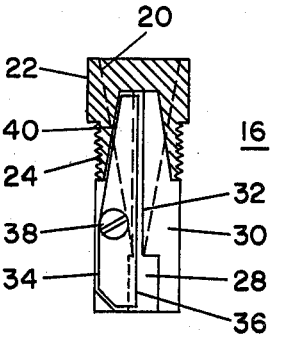
FIG. 5 is a cross-sectional view thereof.
Figure 10:
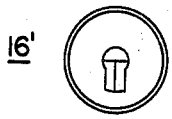
FIG. 10 is an end view thereof.
Figure 7:
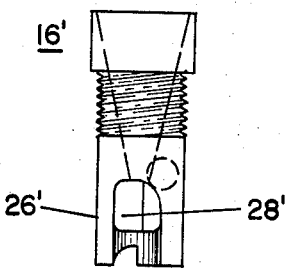
FIG. 7 is a plan view of an alternate crayon sharpening tool for use in the FIG. 1 pencil sharpener.
Figure 8:
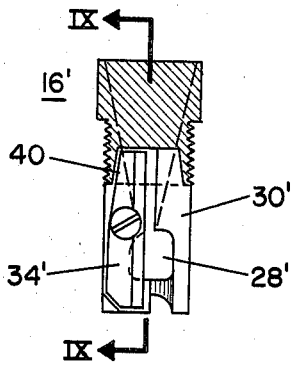
FIG. 8 is a cross-sectional view thereof.
Figure 9:
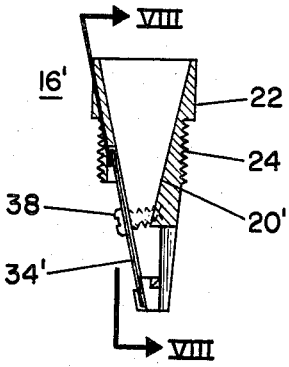
FIG. 9 is another cross-sectional view thereof.
Figure 11:
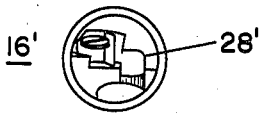
FIG. 11 is another end view thereof.
Figure 14:
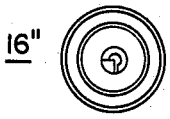
FIG. 14 is an end view thereof.
Figure 13:
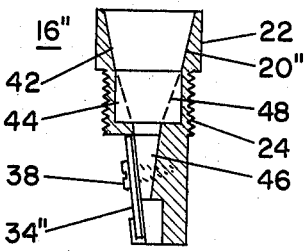
FIG. 13 is a cross-sectional view thereof.
Figure 12:
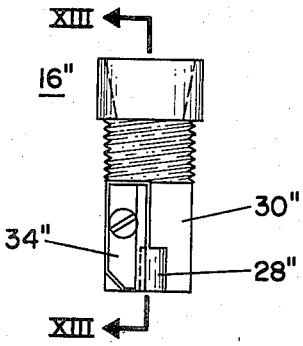
FIG. 12 is a plan view of an alternate drafting pencil sharpening tool for use in the FIG. 1 pencil sharpener.
Figure 15:
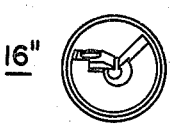
FIG. 15 is another end view thereof.

Further details regarding the construction of tube 12 and tool 16 can be determined from the cross-sectional view of FIG. 2. Tube 12 is of a generally cylindrical configuration with an outside diameter of preferably less than 16 mm, most preferably about 11 or 12 mm, so that the pencil sharpener has the overall shape of a pen. In order to have a pen-shaped configuration, tube 12 should have a length greater than 100 mm., preferably about 130 mm. Tube 12 has a closed end 11 and an open end into which the pencil sharpening tool 16 is mounted by means of threads on an intermediate section 24 which engages a tapped section at the opened end of tube 12. A first outer end of tool 16 has a conical recess 20 for receiving a pencil end for the purposes of sharpening. The opposite end of tool 16 is received inside tube 12. Tool 16 has an outer cylindrical end portion 22, which has a larger diameter than the inside of tube 12 at its opened end, so that when tool 16 is screwed into tube 12 the end portion 22 butts against the wall of tube 12 to position the tool firmly in the end of the tube. As previously mentioned the intermediate portion of tool 16 has a threaded outer surface 24 which engages tube 12. Those skilled in the art will recognize that other forms of attachment are possible, but it is necessary to provide a rigid, non-rotating engagement between the tube 12 and the tool 16 so that the tube can be used to apply sharpening pressure to a pencil. It is also desirable that the tool 16 be removable from the tube 12 for the purpose of emptying shavings which accumulate in the receptacle area 18. Those skilled in the art will recognize the possibility, however, of having a different means of opening the receptacle 18, such as a removable cap provided at the closed end 11.

Further details of the construction of tool 16 will be described with reference to FIGS. 2 to 6.

Tool 16 has a third inner portion 26, which is in the form of a partial cylinder. The third portion 26 departs from a cylindrical configuration by reason of planar surface 30 which is parallel to the wall of conical recess 20 and intersects recess 20 thereby to form a slot 22. Surface 30 extends into and forms a recess 40 in intermediate section 24, having the form of a partial cylinder.

A cutting blade 34 is mounted on surface 30 by screw 38. Cutting blade 34 has a cutting edge 36 which protrudes through slot 32 and extends into conical recess 20 thereby to form a cutting edge for sharpening pencils inserted into recess 20. Blade 34 is tapered at its end which projects into recess 40 to accommodate the limited space within the recess.

From the foregoing description, it can be seen that when a pencil end is inserted into conical recess 20 and the pencil is rotated with respect to tube 12, edge 36 of blade 34 will shave the pencil end to sharpen it while the shavings from the pencil will pass out of recess 40, through the space between surface 30 and tube 12 into the receptacle 18 and be accumulated therein. When it becomes necessary to empty receptacle 18, tool 16 can be screwed out of tube 12 to open receptacle 18 for emptying. When the pencil sharpener is not in use, cap 14 is placed over tool 16 and tube 14, as shown in FIG. 1, to close the pencil sharpener and prevent shavings from falling into a pocket into which the pencil sharpener is placed.

In FIGS. 7 to 11 there is shown an alternate tool 16' for use with the pencil sharpener of FIG. 1. Tool 16' is adapted for the purpose of sharpening crayons. In the figures, portions of tool 16' which are the same as corresponding portions of tool 16 have been designated by corresponding numbers, and modified portions are designated by primed numbers.

Crayon sharpening tool 16' has outer and intermediate portion 22 and 24 identical to the corresponding portion of tool 16 for engagement of the open end of tube 12 as shown in FIG. 2. Conical recess 20' has a larger cone angle to accommodate crayons, and thus planar surface 30' is at a greater angle with respect to the center line of the tool. Accordingly, blade 34' has a shorter length. Other than a larger cone angle, the major change to accommodate crayon sharpening is a substantial enlargement of recess 28', as compared to recess 28 of tool 16. Recess 28' is larger at the inner end of tool portion 26', extends further from the end, and includes a cavity which extends completely through portion 26' in a direction transverse to the planar surface 30'. This enlarged recess accommodates removal of the larger, more adhesive shavings from a crayon, with some sacrifice in strength. It is anticipated that lower strength can be tolerated for crayon sharpening.

FIGS. 12 through 15 illustrate another alternate tool 16'' for use in sharpening drafting pencils, which utilize a relative large diameter, moveable lead, which is clamped into a pencil handle. The recess 20'' therefore is designed to have an outer conical portion 42, an intermediate portion 44 and a small angle, inner conical portion 46. Portions 42 and 44 accommodate the pencil handle while the lead to be sharpened is received in portion 46. Planar surface 30'' is shortened and at an angle which corresponds to conical recess portion 46. Thus this surface does not extend into intermediate tool portion 24 and no partial cylindrical recess is present. Blade 34'' is also shortened and untapered, and end recess 28'' is shortened. As an alternate to the three portions recess 20'', the conical wall of recess portion 42 can be extended in a straight or curved wall section to the start of portion 46 as shown by dotted lines 48.

The pencil sharpener is therefore a convenient tool for executives, engineers or salesmen who use pencils frequently and require a pencil sharpener when away from their own office, but do not wish to use conventional pencil sharpeners, which have no receptacle for shavings and tend to retain shavings which soil the user's pocket. Further, the pencil sharpener can be conveniently placed in a brest pocket, along with pencils, pens and markers, ready for use when required.

While there have been described what are believed to be the preferred embodiments of the present invention, those skilled in the art will recognize that changes and modifications may be made thereto without departing from the spirit of the invention, and it is intended to claim all such modifications as fall within the true scope of the invention.

I claim:

1. A pencil sharpener comprising:

an elongated, substantially cylindrical tube having an open end and a closed end;

a pencil sharpening tool arranged to be connected to said open tube end, said tool having a generally cylindrical configuration having a first outer end and a second inner end for being received in said tube, said outer end having a conical recess formed therein for receiving a pencil end, said tool including a first cylindrical end portion adjacent said outer end and having a diameter greater than the inside diameter of said open end, a second, intermediate cylindrical portion having a smaller diameter and arranged to be received in and engaged by said open end, and a third portion adjacent said second inner end in the form of a partial cylinder having a smaller diameter than the inside diameter of said open end, said third portion for being received into said tube and having an end recess intersecting the end portion of said conical recess, said partial cylinder having a planar surface, parallel to the wall of said conical recess, intersecting said conical recess and forming a longitudinal slot therein, said planar surface extending into said intermediate portion to form a partial cylindrical recess therein, said tool having a blade mounted on said planar surface and having a cutting edge extending into said conical recess through said slot, said blade being tapered in width to fit within said partial cylindrical recess in said intermediate portion;

and a cap fitting over said tube and said tool to close the conical recess therein.

2. A pencil sharpener as specified in claim 1 wherein said intermediate cylindrical portion is threaded and wherein said open tube end is tapped whereby said tool is screwed into said open end.

3. A pencil sharpener as specified in claim 1 wherein said tube has a diameter of less than 16 mm.

4. A pencil sharpener as specified in claim 1, 2 or 3 wherein said tube has a length of at least 100 mm whereby said pencil sharpener has the general shape of a writing implement.

5. A pencil sharpener as specified in claim 4 wherein said cap is provided with a pocket clip.

6. A pencil sharpener comprising:

an elongated, substantially cylindrical tube having an open end and a closed end;

a pencil sharpening tool arranged to be connected to said open tube end, said tool having a generally cylindrical configuration having a first outer end and a second inner end for being received in said tube, said outer end having a conical recess formed therein for receiving a pencil end, said tool including a first cylindrical end portion adjacent said outer end and having a diameter greater than the inside diameter of said open end, a second, intermediate cylindrical portion having a smaller diameter and arranged to be received in and engaged by said open end, and a third portion adjacent said second inner end in the form of a partial cylinder having a smaller diameter than the inside diameter of said open end, said third portion for being received into said tube and having an end recess intersecting the end portion of said conical recess, said partial cylinder having a planar surface, parallel to the wall of said conical recess, intersecting said conical recess and forming a longitudinal slot therein, said tool having a blade mounted on said planar surface and having a cutting edge extending into said conical recess through said slot;

and a cap fitting over said tube and said tool to close the conical recess therein.

7. A pencil sharpener as specified in claim 6 wherein said intermediate cylindrical portion is threaded and wherein said open tube end is tapped whereby said tool is screwed into said open end.

8. A pencil sharpener as specified in claim 6 wherein said tube has a diameter of less than 16 mm.

9. A pencil sharpener as specified in claim 6, 7 or 8 wherein said tube has a length of at least 100 mm whereby said pencil sharpener has the general shape of a writing implement.

10. A pencil sharpener as specified in claim 9 wherein said cap is provided with a pocket clip.

11. A pencil sharpener as specified in claim 6 wherein there are provided a plurality of said tools, said tools being interchangeable in said tube.

12. A pencil sharpening tool arranged to be connected to an open end of a shaving receiving tube, said tool having a generally cylindrical configuration having a first outer end and a second inner end for being received in said tube, said outer end having a conical recess formed therein for receiving a pencil end, said tool including a first cylindrical end portion adjacent said outer end and having a diameter greater than the inside diameter of said open end, a second, intermediate cylindrical portion having a smaller diameter and arranged to be received in and engaged by said open end, and a third portion adjacent said second inner end in the form of a partial cylinder having a smaller diameter than the inside diameter of said open end, said third portion for being received into said tube and having an end recess intersecting the end portion of said conical recess, said partial cylinder having a planar surface, parallel to the wall of said conical recess, intersecting said conical recess and forming a longitudinal slot therein, said tool having a blade mounted on said planar surface and having a cutting edge extending into said conical recess through said slot.

13. A pencil sharpening tool as specified in claim 12 wherein said intermediate cylindrical portion is threaded whereby said tool can be screwed into a tapped tube end.

14. A pencil sharpening tool as specified in claim 12 wherein said planar surface extends into said intermediate portion to form a partial cylindrical recess therein.

15. A pencil sharpening tool as specified in claim 14 wherein said blade is tapered to width to fit within said partial cylindrical recess in said intermediate section.

16. A pencil sharpening tool as specified in claim 12, for sharpening drafting pencils, wherein said conical recess has an inner portion for receiving a pencil lead and an outer portion for receiving a pencil handle.

17. A pencil sharpening tool as specified in claim 12 for sharpening crayons wherein said end recess extends through said third tool portion in a direction transverse to said planar surface.

* * * * *